United States Patent [19]

Neuman

[11] Patent Number: 4,881,886

[45] Date of Patent: Nov. 21, 1989

[54] COMPRESSION HEAD FOR MACHINE FOR CONTINUOUSLY DENSIFYING VEGETABLE MATTER

[75] Inventor: Marcel Neuman, Eumbourg, Belgium

[73] Assignee: Biomass Development Europe SA, Brussels, Belgium

[21] Appl. No.: 194,909

[22] Filed: May 17, 1988

[30] Foreign Application Priority Data

May 26, 1987 [FR] France ..... 87 07608

[51] Int. Cl.[4] ..... B28B 21/26

[52] U.S. Cl. ..... 425/208; 366/82; 366/87; 425/376.1; 425/378.1; 425/382.3; 425/382.4

[58] Field of Search ..... 366/79, 80, 82, 87, 366/99; 425/200, 202, 206, 207, 208, 209, 376.1, 378.1, 382.3, 382.4

[56] References Cited

U.S. PATENT DOCUMENTS

| | | | |
|---|---|---|---|
| 2,224,212 | 12/1940 | Bowling | 425/378.1 |
| 3,187,382 | 6/1965 | Lowe | 425/382.4 |
| 3,496,604 | 2/1970 | Schwalm | 425/376.1 |
| 3,506,415 | 4/1970 | Paladino | 425/378.1 |
| 3,605,186 | 9/1971 | Wagner | 425/376.1 |
| 4,124,347 | 11/1978 | Miller | 425/208 |

FOREIGN PATENT DOCUMENTS

| | | | |
|---|---|---|---|
| 1283496 | 11/1968 | Fed. Rep. of Germany | 425/208 |
| 2458383 | 2/1981 | France | 425/382.3 |

*Primary Examiner*—Jay H. Woo
*Assistant Examiner*—C. Scott Bushey
*Attorney, Agent, or Firm*—Dowell & Dowell

[57] ABSTRACT

A compression head for a machine for continuously densifying vegetable matter, wherein radial or virtually radial bars are included in the front face of the disc of the head and are made of a material presenting a coefficient of friction greater than that of the material of which the disc is made. The outer face of the bars is shaped so that the conventional ribs on the front face of the disc are continuous through the bars.

14 Claims, 3 Drawing Sheets

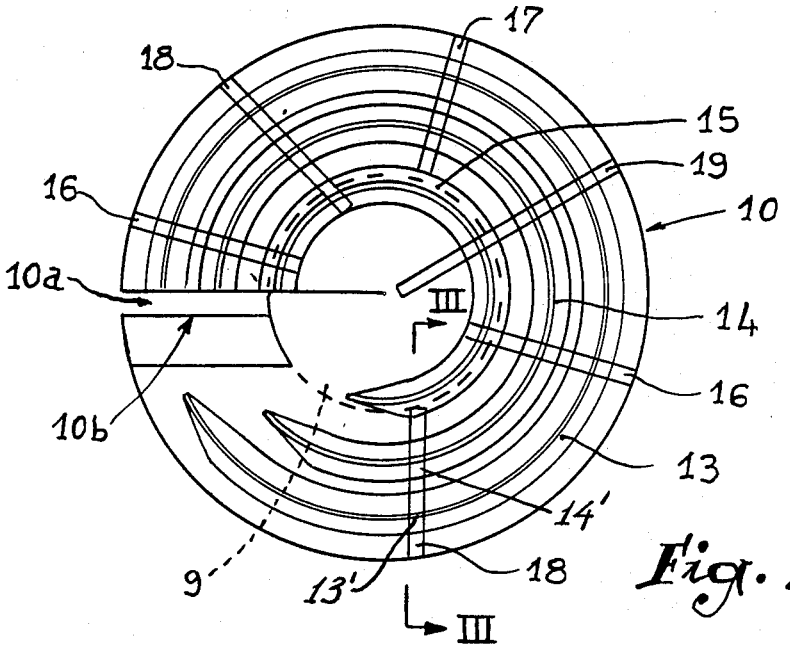
Fig. 2
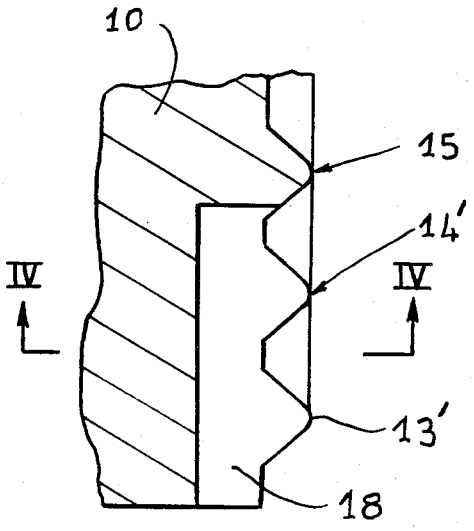
Fig. 3
Fig. 4
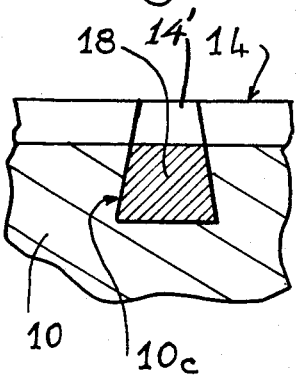

COMPRESSION HEAD FOR MACHINE FOR CONTINUOUSLY DENSIFYING VEGETABLE MATTER

BACKGROUND OF THE INVENTION

1. Field of the Invention

The present invention relates to improvements in or relating to machines for densifying vegetable matters, such as wood waste, waste from the agrifoodstuffs industry, and the like and for making combustible logs or billets.

2. History of the Related Art

All vegetable matter contains, inter alia, cellulose and lignin; the latter begins to plasticize, liquefy, at about 100° C.; it is therefore of interest to produce, in the densifying machines, a temperature greater than 100° C. in the mass of the vegetable matter.

In fact, the lignin being liquid, the particles of vegetable matter are coated therewith and, during cooling of the logs or billets, the lignin performs the role of natural binding agent on resolidifying.

After cooling, the logs or billets consequently have a natural protective film against atmospheric humidity, a greater mechanical strength, an excellent homogeneity and their shape remains stable during combustion.

Different types of machines of continuously densifying vegetable matter exist, incorporating; piston, rotating drum, screw, and those deriving from U.S. Pat. No. 2,224,212.

Vegetable waste frequently contains foreign bodies and in particular silica coming for example from the bark of trees, or earth contained in the agri-foodstuff waste. The foreign bodies wear certain members of the machines more rapidly.

Known densifying machines deriving from U.S. Pat. No. 2,224,212 comprise a compression head whose function is to create a high pressure and a considerable rise in temperature by friction on the front face and within the mass of vegetable matter located between the head and the extrusion die; the temperature in the mass of vegetable matter may attain and exceed 180° C. The compression head is the wearing piece of the machine.

With a view to reducing the temperature of the compression head and to avoiding too rapid destruction thereof, it has been provided in the prior art machines to cool this head.

SUMMARY OF THE INVENTION

It is an object of the improvements according to the present invention to overcome this drawback by producing a compression head for a densifying machine which does not need to be cooled and which, on the contrary, comprises means for creating additional pressure drops in order that compression of the vegetable matter takes place at high temperature.

To that end, radial bars are placed on the front face of the head whose constituent material presents a coefficient of friction greater than that of the material forming the head. The friction bars are made of a hard material capable of withstanding high temperatures and dry abrasion. By way of non-limiting example, tungsten carbides, ceramics, boron nitrides, titanium carbides, titanium nitrides, etc . . . may be selected.

The friction of the vegetable matter on the face of the compression head then causes a considerable rise in temperature of the compression head which may attain 500° C.

The radial or substantially radial arrangement of the bar has for its consequence to create an additional friction and to cause turbulences in the vegetable matter, leading to an additional increase in temperature favorable to production.

BRIEF DESCRIPTION OF THE DRAWINGS

The invention will be more readily understood on reading the following description with reference to the accompanying drawings, in which:

FIG. 2 is a front view of the compression head according to the invention.

FIG. 3 is a view along III—III (FIG. 2). This Figure shows the plane of section IV—IV of FIG. 4.

FIG. 4 is a partial assembly view of one of the bars of the present invention in the corresponding groove in the disc.

DESCRIPTION OF THE PREFERRED EMBODIMENT

Figure 1:
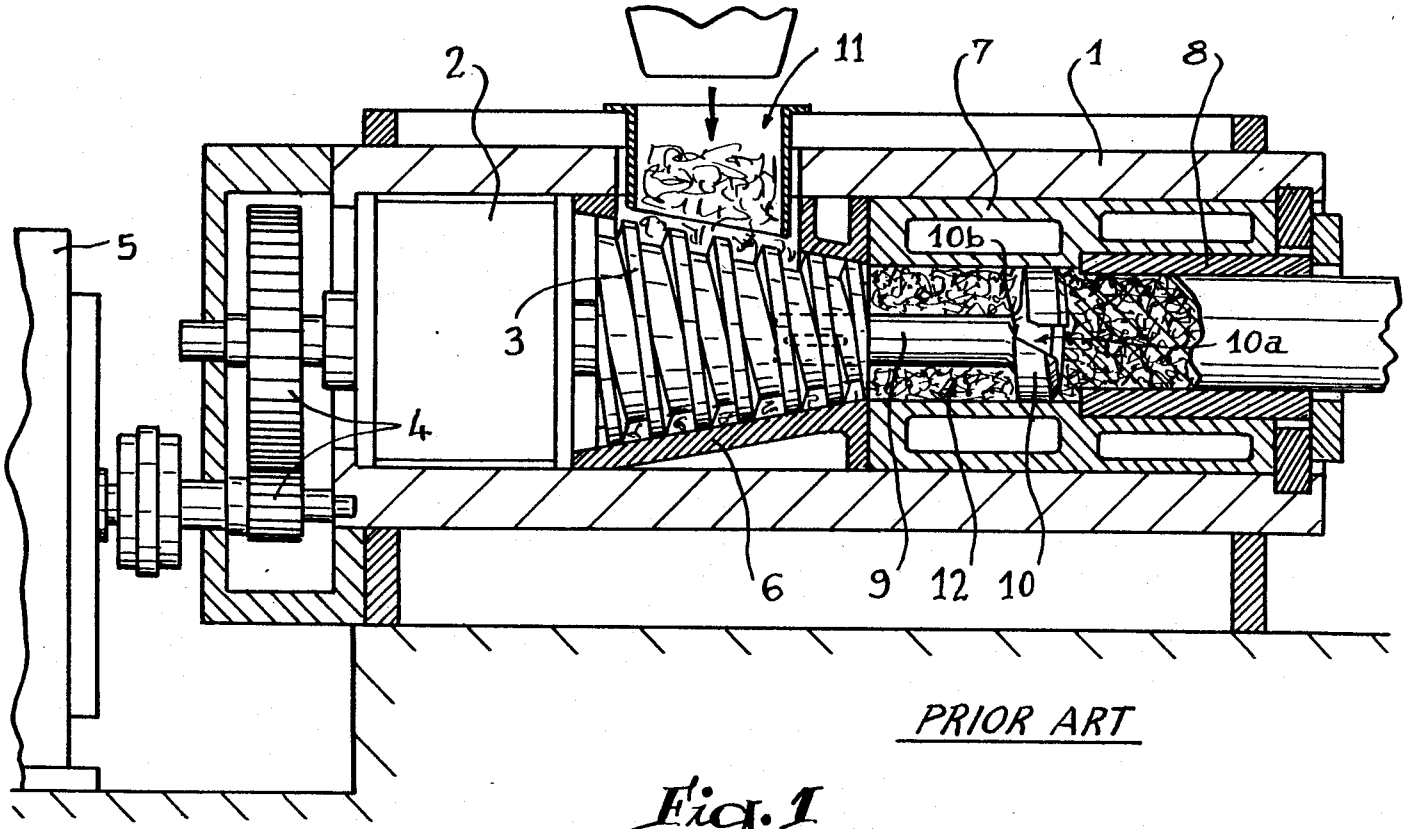
PRIOR ART Fig. 1
FIG. 1 is a longitudinal section through a conventional densifying machine.
Figure 5:
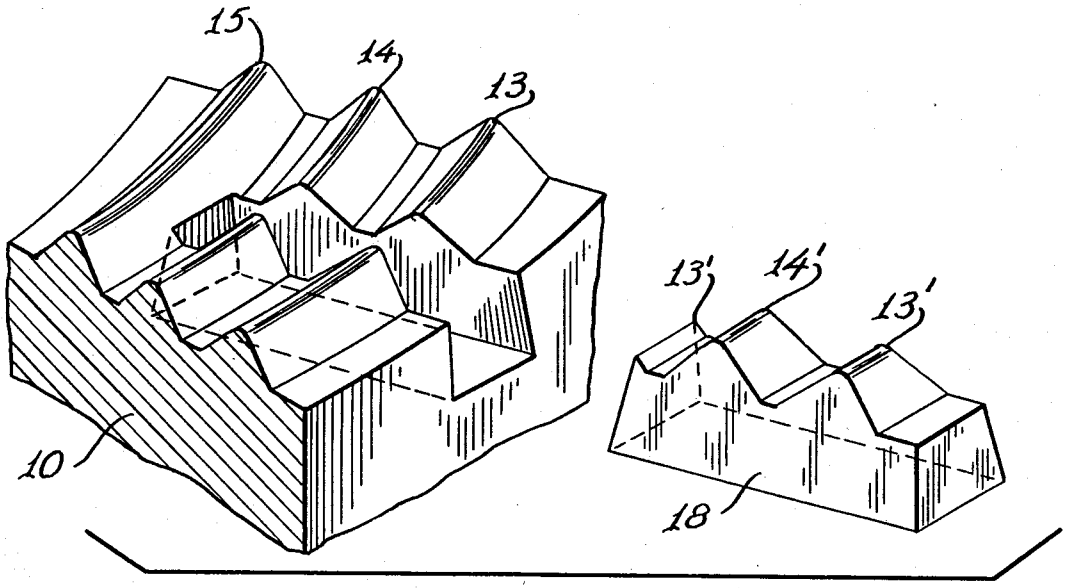

Referring now to the drawings, a conventional densifying machine of the type illustrated in FIG. 1, essentially comprises a sleeve element 1 of which one of the ends supports a bearing 2 comprising rollers (not shown) allowing rotation of a truncated Archimedian screw 3 via gears 4 driven by a motor 5. The screw 3 is surrounded by a jacket 6 followed by a cylinder 7 of which the outward opening, i.e. opposite screw 3, holds a die 8.

It will be noted that screw 3 is fastened to a rod 9 of diameter clearly less than the smallest diameter of the screw. The end of the rod 9 opposite the screw is being provided with a disc 10 whose front face and rear face are helicoidal. A slot **10*a* is made in the disc 10** which in fact acts as a mill.

Such a machine is perfectly well known in the art in question and will therefore not be described in greater detail.

It will merely be recalled that vegetable matter is introduced via an opening 11 made in the sleeve element 1; that this matter is consequently taken towards the right in FIG. 1, passing in the space 12 included between the cylinder 7 and the rod 9. The matter is then compressed by the screw in this space and is shred by the edge **10*b* of the rear face of the disc 10; finally, it passes through slot 10*a*** to the front of the disc.

It will be observed that the jacket 6 and the cylinder 7 are provided with chambers intended for cooling the assembly.

As illustrated in FIG. 2, the front face of the disc 10 is conventionally provided with a plurality of circular beads referenced 13, 14 and 15 starting from the outside. Although this is not compulsory, it is advantageous to provide these ribs to be concentric. Their role is to prevent centrifugal displacement of the compressed matter lying in front of the disc 10. They issue from the leading edge of the slot **10*a*** and terminate on the opposite edge of the slot.

According to the invention, there are included in the front face of the disc 10 a plurality of bars 16 preferably oriented radially and which extend either over a part of a radius of the face in question, or over the whole of its extent. Thus, bars 16 are located between the inner edge of the central rib 15 up to the periphery of the disc 10.

Other, shorter, bars 17 may be provided, others, 18, not radial, but slightly oblique with respect to a radius and, finally, radial or oblique bars 19 over the whole width of the front face of the disc 10.

The radial bars included in the front face of the head are made of a material presenting a coefficient of friction greater than that of the material of which the disc is made and which is highly polished.

The outer face of the bars is shaped so that the ribs of the front face of the disc 10 do not present a gap, nor shoulder. In other words, the outer face of the bars comprises corrugations continuing the ribs 13, 14 and 15 as illustrated in FIG. 3 and is shown at 13', 14' and 15' in the drawing figures.

Finally, the bars may present in transverse section a trapezoidal form so as to be engaged in grooves 10c made in the disc 10. Other means for fastening the bars to the disc 10 may of course be utilized without departing from the domain of the invention.

The radial arrangement or the arrangement at a certain angle of the bars 16, 17, 18, made of a material resistant to high temperatures and dry abrasion, makes it possible considerably to limit the wear by friction of the front face of the disc 10, thus increasing the duration of work between two replacements, with the result that there is a possibility of increasing the production yield. By way of example the bars may be made of such materials as tungsten carbides, ceramics, boron nitrides, titanium carbides, titanium nitrides and like materials.

The radial arrangement of arrangement at a certain angle of the bars mentioned above presents a second, very important advantage. Their presence makes it possible to increase the temperature in the mass of the vegetable matter included between the front face of the disc 10 and the extrusion die 8. This results in obtaining a quality of logs, from the standpoint of their density, their homogeneity, their mechanical strength, their resistance to atmospheric humidity and their stable shape during combustion, which cannot be obtained with the billets manufactured with the conventional machines. As has already been set forth, the rise in temperature comes from the effect of turbulence in the ligneous-cellulosic materials which is caused by the radial or virtually radial arrangement of the bars 16, 17, 18 and 19 and by the difference of coefficient of friction existing between the material of the disc 10 and that of the bars.

It must, moreover, be understood that the foregoing description has been given only by way of example and that it in no way limits the domain of the invention which would not be exceeded by replacing the details of execution described by any other equivalents.

What is claimed is:

1. In a compression head for machines for continuously densifying vegetable matter and which is mounted by a rod to a conical Archimedean screw and which includes an end disc which is formed of a first material and has a helicoidal front face provided with a plurality of generally circular ribs extending from the leading edge of a slot in the disc and which terminate on the opposite edge of the slot, the improvement comprising friction increasing means formed in the front face of the disc, said friction increasing means being formed of a second material having a higher coefficient of friction than the first material of the disc whereby the friction increasing means will by friction increase the temperature of the vegetable matter acted on by the compression head.

2. The compression head of claim 1 in which said friction increasing means includes at least one bar insert which extends inwardly of the front face of the disc so as to intersect with at least one of the ribs.

3. The compression head of claim 2 in which said bar insert includes an outer face, said outer face including at least one raised portion which is shaped so as to be complementary with said at least one rib whereby said at least one rib appears continuous where said bar insert intersects therewith.

4. The compression head of claim 3 in which said bar insert extends generally radially with respect to the front face of the end disc.

5. The compression head of claim 1 including a plurality of spaced bar inserts extending inwardly of the front face so as to intersect with at least one rib, each of said bar inserts having an outer face having at least one raised portion of the shape complementary to any rib with which said bar inserts intersect.

6. The compression head of claim 5 in which at least one of said bar inserts extends substantially along a full radius of the front face of the end disc.

7. The compression head of claim 5 wherein a number of said bar inserts are of different lengths.

8. The compression head of claim 5 wherein said bar inserts are mounted within tapered slots formed in the front face of the end disc.

9. The compression head of claim 5 wherein at least two of said bar inserts are mounted so as to have differing angular relationship with respect to the front face of the end disc.

10. The compression head of claim 1 in which said friction increasing means is formed of a material selected from a group of materials consisting of tungsten carbides, ceramics, boron nitride, titanium carbide and titanium nitrides.

11. In a compression head for machines for continuously densifying vegetable matter and which is mounted by a rod to a conical Archimedean screw and which includes an end disc which is formed of a first material and has a helicoidal front face provided with a plurality of generally circular ribs extending from the leading edge of a slot in said the disc and which terminate on the opposite edge of the slot, the improvement comprising a plurality or spaced bar inserts mounted to the front face of the end disc and extending inwardly of the front face so as to intersect with at least one rib, each of said bar inserts having an outer face having at least one raised portion of a shape complementary to any rib with which said bar inserts intersect, and said bar inserts being formed of a second material having a higher coefficient of friction than the first material of the end disc, whereby the friction increasing means will by friction increase the temperature of the vegetable matter acted on by the compression head.

12. The compression head of claim 11 wherein said bar inserts are mounted within tapered slots formed in the front face of the end disc.

13. The compression head of claim 12 wherein at least two of said bar inserts are mounted so as to have differing angular relationship with respect to the front face of the end disc.

14. The compression head of claim 12 wherein a number of said bar inserts are of different lengths.

* * * * *